United States Patent [19]

Girardin et al.

[11] Patent Number: 4,755,073

[45] Date of Patent: Jul. 5, 1988

[54] APPLIANCE WITH A GAS BURNER FOR THE APPLICATION OF A HOT MELT ADHESIVE

[75] Inventors: Pascal Girardin, Thurins; Pierre Sivignon, Lyons, both of France

[73] Assignee: Application des Gaz, Paris, France

[21] Appl. No.: 14,788

[22] Filed: Feb. 13, 1987

[30] Foreign Application Priority Data

Feb. 17, 1986 [FR] France ..... 8602285

[51] Int. Cl.[4] ..... B05C 17/00; B67D 5/66; F04B 21/00

[52] U.S. Cl. ..... 401/1; 401/2; 222/113; 222/146.2; 126/401

[58] Field of Search ..... 401/1, 2; 222/113, 146.2; 126/401, 284; 228/52, 53

[56] References Cited

U.S. PATENT DOCUMENTS

| | | | |
|---|---|---|---|
| 2,997,869 | 8/1961 | Weiss | 126/401 X |
| 4,262,820 | 4/1981 | Flint | 222/146.2 |
| 4,535,916 | 8/1985 | Mächerle et al. | 222/146.2 X |
| 4,635,382 | 1/1987 | Bourdeau | 126/401 X |

FOREIGN PATENT DOCUMENTS

| | | | |
|---|---|---|---|
| 0123259 | 10/1984 | European Pat. Off. . | |
| 2017757 | 6/1971 | Fed. Rep. of Germany | 222/146.2 |
| 2732365 | 2/1978 | Fed. Rep. of Germany . | |
| 1095865 | 6/1955 | France . | |
| 1228433 | 8/1960 | France . | |
| 636765 | 7/1950 | United Kingdom | 126/401 |
| 2118253 | 10/1983 | United Kingdom . | |
| 2156440 | 10/1985 | United Kingdom . | |

*Primary Examiner*—Richard J. Apley
*Assistant Examiner*—David J. Bender
*Attorney, Agent, or Firm*—Parkhurst & Oliff

[57] ABSTRACT

Its casing (1) comprises two adjacent compartments, leakproof in respect of each other, namely a first compartment situated at the rear, in communication with primary or combustive air inlet ports (1*a*), in which the entry (7*a*) of the burner (7) is arranged, and a second compartment containing most of the melting duct (4) and the remainder of the burner (7), in communication with ports for the removal (1*b*) of the combustion fumes.

6 Claims, 3 Drawing Sheets

APPLIANCE WITH A GAS BURNER FOR THE APPLICATION OF A HOT MELT ADHESIVE

The present invention relates to appliances for the application of a hot-melt adhesive, which are generally referred to by the users by the name of "glue guns".

It has been known for many years in the case of various portable appliances for domestic or professional use, employing electric heating means, for example a resistor, to substitute a burner for the latter, a container holding the fuel being additionally incorporated in the appliance. This results in appliances which are self-contained, that is to say without a supply cable from a source of electric energy.

Thus, according to the document U.S. Pat. No. 2,997,869, there has been proposed a soldering iron with a burner and more precisely with a catalytic burner, comprising:

a casing forming a grip handle, containing a container for methanol:

a catalytic means of heating and vaporizing the methanol;

a catalytic burner for the vaporized methanol, comprising a chamber for combustion in contact with an appropriate catalyst; and a metal body forming the bit of the soldering iron, arranged in the middle and on the axis of the combustion chamber, collecting the heat of combustion.

In actual fact, catalytic burners appear to be highly suitable for use in portable appliances requiring a source of heat, on the one hand because of the combustion temperature developed by burners of this type, which is much lower than that of naked-flame burners, including radiating burners, and, on the other hand, because of their ability to radiate well the heat which is produced, when compared with the other mechanisms of heat transmission (especially convection).

This is why catalytic burners have received all kinds of configurations, including tubular configurations, in order to be used in a suitable manner in various applications like those illustrated in the documents FR-A-1,228,433 and FR-A-1,095,865.

Insofar as glue guns are concerned, it is known that, in their electric version, they generally comprise:

a casing with a grip handle, having an orifice at the rear for feeding sticks of solid adhesive;

a nozzle for dispensing the molten adhesive, arranged at the front of the casing; and a single-unit metal assembly combining, on the one hand, a melting duct for the sticks, which is arranged at least partly within the casing and one end ow which is in communication with the dispensing nozzle, and, on the other hand, a hollow, blind, heating body, situated uncer the melting duct and parallel thereto, and housing an electric resistor.

In various documents, for example DE-A-2,118,253 and GB-A-2,156,440, it has been proposed to substitute a burner for the electric resistor, especially a catalytic burner, in order to make these glue guns completely self-contained, provided that a container of liquified fuel gas is incorporated in the appliance, for example in the handle. Thus, according to the documents DE-A-2,732,365 and EP-A-0,123,259, a catalytic burner is arranged around the heating duct.

The glue guns with a catalytic burner using gas which have been proposed by the prior art do not appear to be satisfactory in practice, and this makes them unsuitable, in particular, for daily use by professionals or by skilled users, and the purpose of the invention is to improve an appliance of this type until it becomes a product which is reliable and efficient in operation.

According to the invention, the casing comprises two adjacent compartments, leakproof in respect of each other, namely a first compartment situated at the rear, in communication with primary or combustive air inlet ports, in which the entry of the burner is arranged, and a second compartment containing most of the melting duct and the remainder of the burner, in communication with ports for the removal of the combustion fumes.

This technical feature makes it possible to separate the path of the incoming air from that of the combustion fumes and, in particular, to avoid any mixing of the combustive air with the combustion fumes or gases within the apparatus, that is to say inside the casing. This result is essential, since it is known that a glue gun is used in any position, including nozzle downwards, in which position the combustion fumes unavoidably rise upwards and hence towards the combustive air inlet.

Preferably, a combustion fume baffle is situated at the front of the melting duct and of the combustion chamber in order to bring into communication, on one side, an open end of the said chamber which is away from the burner entry and, on the other side, an annular region situated around the melting duct in the vicinity of the dispensing nozzle, a combustion fume outlet opening being arranged in the baffle in the annular region.

In this way, the combustion fumes heat the front part of the heating duct, adjoining the nozzle, and also the latter. During operation, this makes it possible to avoid any cooling of the glue, which increases its viscosity, between the part of the heating body facing the burner, and the nozzle, and hence not to impede the operation of the latter. Furthermore, when the glue gun is switched on or is restarted, for example by the action of a control, the front part of the melting duct and the nozzle are immediately heated without waiting for the input of heat originating from the remainder of the melting duct or the molten adhesive.

The attached drawing, which is given by way of example, will permit better understanding of the invention, its characteristics and the advantages which it is capable of providing:

Figure 1:
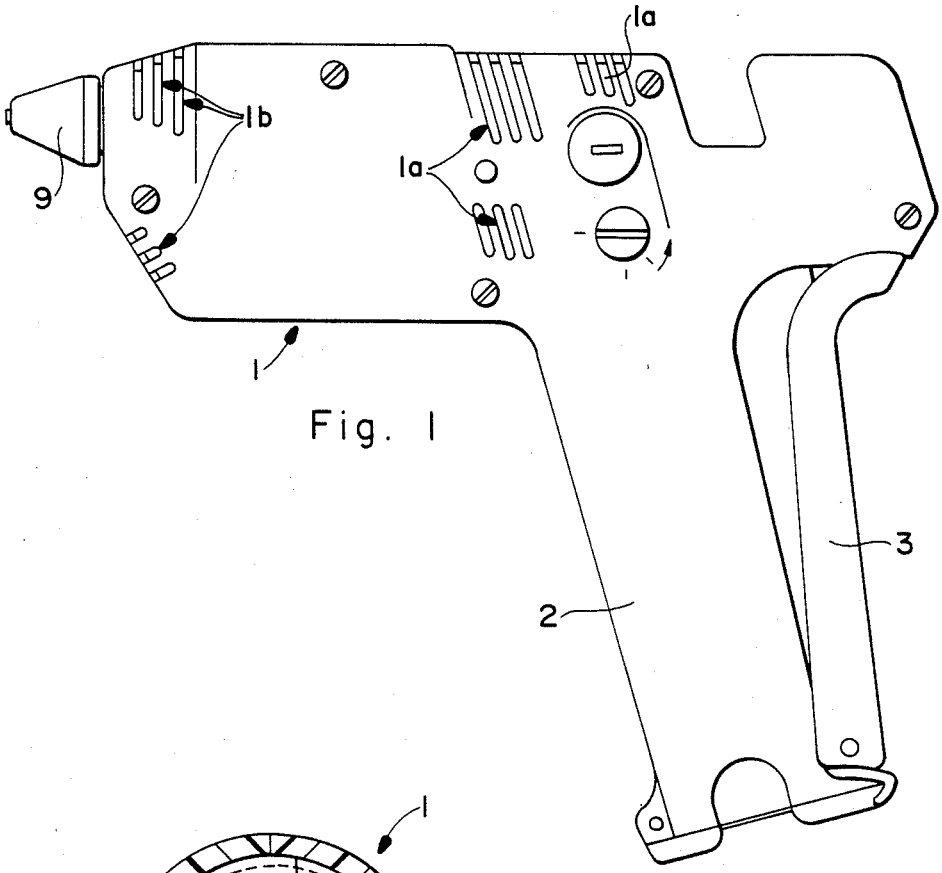
FIG. 1 is an elevation view of an appliance constructed in accordance with the invention.
Figure 3:
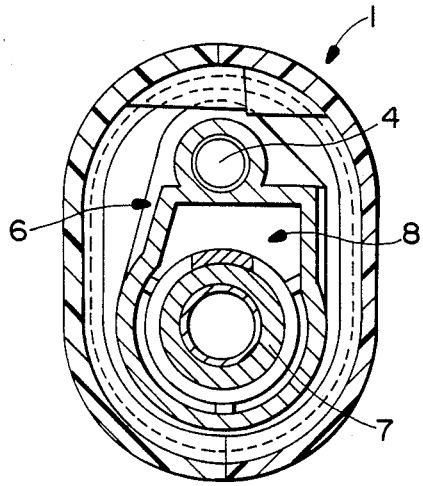
FIG. 3 is a section along III—III (FIG. 2).
Figure 2:
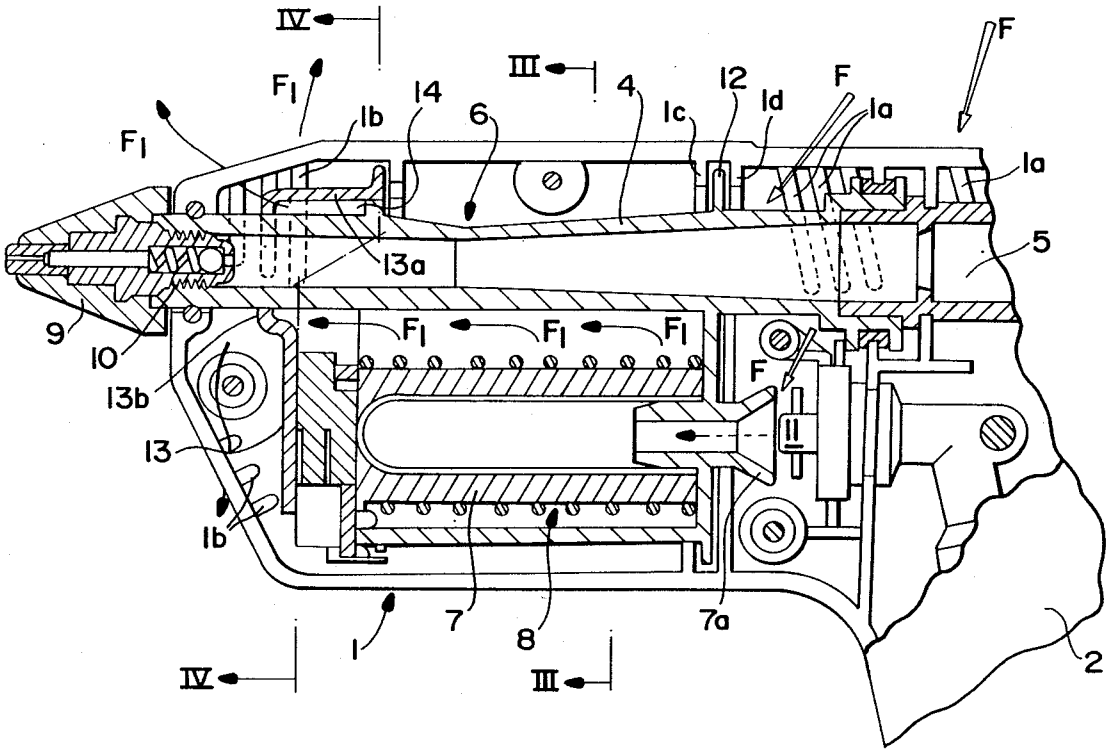
FIG. 2 is a partial lengthwise section on a larger scale.
Figure 4:
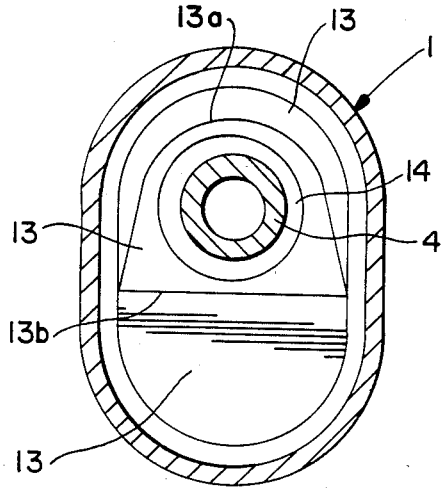
FIG. 4 is a section along IV—IV (FIG. 2).

FIG. 1 illustrates an appliance for applying a hot-melt adhesive, essentially comprising a casing 1 provided with a grip handle 2 and a counter-handle 3 permitting sticks of glue to be driven forward into a melting duct 4 (FIG. 2) from an entry orifice 5. The melting duct forms part of a single-unit assembly 6 which also comprises a gas burner 7, preferably made in the form of a catalytic burner, and arranged in a combustion chamber 8. Under these conditions, the burner 7 is in a heat exchange relationship with the melting duct 4, whose end away from the orifice 5 is equipped with a dispensing nozzle 9 which incorporates a nonreturn valve 10.

The casing 1 comprises ports or slots 1*a* permitting the entry of primary or combustive air in the direction of the injector 7*a* of the burner 7, situated around a fuel gas delivery nozzle 11. The arrows F show the path followed by the combustive air as it enters the casing 1 and reaches the injector *7a*.

The single-unit assembly 6 is equipped, slightly upstream of the injector *7a* in relation to the direction in which the fuel gas enters the burner 7, with a separating partition made in the form of an annular screen 12, connecting the said single-unit assembly 6 and the inner face of the casing 1 in a virtually leakproof manner. Thus, in the said casing, this annular screen 12 forms two adjacent compartments which are leakproof in respect of each other. The first compartment, which is situated upstream, that is to say at the rear of the casing in relation to the nozzle 9, is in communication with the entry ports for primary or combustive air. The injector *7a* of the burner 7 is arranged in this compartment. The second compartment, containing most of the melting duct and the burner 4, that is to say, in fact, the major proportion of the single-unit assembly 6, is in communication with the outside via other ports *1b* made in the form of slots passing through the wall of the casing 1. Arrows F1 have been used to illustrate the path of the burnt gases from the burner 7 to the outside.

Thus, when the burner is in operation and when the gun user applies the adhesive with the melting duct 4 pointing vertically, the combustion fumes or gases cannot rise into the first compartment of the casing, with the result that the pure combustive air is not contaminated by the combustion gases. It can be seen that the fitting of the single-unit assembly 6 is made easier by the presence of the annular screen 12, which is held between ribs *1c*, *1d* which are arranged transversely in the casing 1.

It will be noted that the front of the single-unit assembly 6 is equipped with a baffle screen 13 made in the shape of a recovery shell comprising a virtually cylindrical part *13a* surrounding the front of the duct 4, which cylindrical comprises an annular opening *13b* surrounding the duct 4 and permitting passage of combustion gas between the baffle 13 and the duct 4 through an anular region 14. so that the said burnt gases are forced to skirt the annuar region 14 the, in order to heat this region which is situated in a place where the heat contact between the burner and the said heating channel is considerably reduced.

This heating of the outlet of the melting duct 4 also permits heating of the nozzle 9, so that the valve 10 can operate with complete safety.

It should be understood, furthermore, that the above description has been given only by way of example and that it does not in any way limit the field of the invention, and that replacement of the described details of embodiment by any other equivalents does not constitute a departure therefrom.

What is claimed is:

1. An appliance for the application of a hot-melt adhesive, comprising:

a casing comprising a grip handle, said casing having an orifice for feeding stickes of solid adhesive;

a single-unit metal assembly, said assembly comprising a melting duct into which sticks of solid adhesive are fed, at least a portion of said assembly being positioned within the casing, one end of said assembly being in communication with a nozzle for dispensing said adhesive;

a gas burner, extending in the direction of the melting duct, in heat exchange relationship with said melting duct, said nozzle being arranged at an outlet of said melting duct; and means for supplying fuel to said burner;

wherein the casing comprises two adjacent compartments, leakproof in respect of each other, a first compartment in communication with primary or combustive air inlet ports, in which an entry to said burner is arranged, and a second compartment in which most of the melting duct and the remainder of the burner are positioned, said second compartment being in communication with ports for the removal of combustion fumes.

2. The appliance as claimed in claim 1, wherein the two compartments are defined by a separating partition in the form of an annular screen perpendicular to the single-unit metal assembly, the periphery of said partition corresponding to the internal shape of said casing, said partition being situated adjacent where combustive air enters into said burner or downstream of said burner.

3. The appliance as claimed in claim 1, further comprising a baffle for deflecting combustion fumes, said baffle being positioned at the front of the melting duct and of a combustion chamber, said baffle allowing communication between, on one side, an open end of said chamber, away from the entry of said burner, and, on the other side, an annular region situated around the melting duct, in the vicinity of the dispensing nozzle, at least one of said ports for removal of combustion fumes being arranged in the baffle in said annular region.

4. An appliance for the application of a hot-melt adhesive, comprising a casing and a single-unit assembly, said single-unit assembly being positioned within said casing and comprising a melting duct, a gas burner, a combustion chamber and means for supplying fuel to said burner, said melting duct having an entry orifice into which sticks of solid adhesive are fed and a dispensing nozzle for dispensing said adhesive, said gas burner being positioned in said combustion chamber and in heat exchange relation with said melting duct, said casing comprising air inlet ports through which air passes from outside said casing to said means for supplying fuel, and combustion products removal parts through which combustion products pass from inside said casing to outside said casing, said casing defining first and second compartments, said first compartment communicating with said air inlet ports, said second compartment communicating with said combustion products removal ports.

5. An appliance as recited in claim 4, wherein said first and second compartments are separated by a partition comprising an annular screen arranged perpendicular to said single-unit metal assembly, the periphery of said partition corresponding to the interior of said casing, said partition being positioned adjacent said fuel supplying means.

6. An appliance as recited in claim 4, further comprising a baffle positioned in said casing, said baffle having an opening through which said melting duct extends, said baffle and said melting duct defining an annular opening, said annular opening permitting communication between said second compartment and said combustion products removal ports.

* * * * *